US011387568B2

(12) United States Patent
Stanley et al.

(10) Patent No.: US 11,387,568 B2
(45) Date of Patent: Jul. 12, 2022

(54) MILLIMETER-WAVE ANTENNA ARRAY ELEMENT, ARRAY ANTENNA, AND COMMUNICATIONS PRODUCT

(71) Applicant: Huawei Technologies Co., Ltd., Shenzhen (CN)

(72) Inventors: Manoj Stanley, Liverpool (GB); Yi Huang, Liverpool (GB); Hanyang Wang, Reading (GB); Hai Zhou, Reading (GB); Xiaoyin He, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 68 days.

(21) Appl. No.: 17/053,229

(22) PCT Filed: May 9, 2018

(86) PCT No.: PCT/CN2018/086197
§ 371 (c)(1),
(2) Date: Nov. 5, 2020

(87) PCT Pub. No.: WO2019/213878
PCT Pub. Date: Nov. 14, 2019

(65) Prior Publication Data

US 2021/0313703 A1 Oct. 7, 2021

(51) Int. Cl.
*H01Q 21/00* (2006.01)
*H01Q 1/52* (2006.01)
(Continued)

(52) U.S. Cl.
CPC ..... *H01Q 21/0006* (2013.01); *H01Q 1/52* (2013.01); *H01Q 21/065* (2013.01); *H01Q 1/48* (2013.01)

(58) Field of Classification Search
CPC .... H01Q 1/523; H01Q 21/0006; H01Q 21/06; H01Q 21/065; H01Q 21/24; H01Q 5/30;
(Continued)

(56) References Cited

U.S. PATENT DOCUMENTS 7,486,239 B1 * 2/2009 Channabasappa ... H01Q 9/0414 343/700 MS
11,211,718 B2 * 12/2021 Ueda ..... H01Q 21/245
(Continued)

FOREIGN PATENT DOCUMENTS

CN 101411027 A 4/2009
CN 103490151 A 1/2014
(Continued)

*Primary Examiner* — Jason Crawford
(74) *Attorney, Agent, or Firm* — Conley Rose, P.C.

(57) ABSTRACT

A millimeter-wave antenna array element includes a ground layer, a first dielectric layer, a first radiation patch, a second dielectric layer, and a second radiation patch. At least a part of the first feeding part is disposed inside the first dielectric layer, or inside the second dielectric layer, or between the first dielectric layer and the second dielectric layer, and the first feeding part is insulated from the first radiation patch, the second radiation patch, and the ground layer. At least a part of the second feeding part is disposed inside the first dielectric layer, or inside the second dielectric layer, or between the first dielectric layer and the second dielectric layer, and the second feeding part is insulated from the first feeding part, the first radiation patch, the second radiation patch, and the ground layer.

20 Claims, 12 Drawing Sheets

(51) Int. Cl.
*H01Q 21/06* (2006.01)
*H01Q 1/48* (2006.01)

(58) Field of Classification Search
CPC ..... H01Q 5/378; H01Q 9/04; H01Q 9/0407; H01Q 9/0414; H01Q 9/0457; H01Q 19/005
See application file for complete search history.

(56) References Cited

U.S. PATENT DOCUMENTS

| | | | | |
|---|---|---|---|---|
| 2009/0091499 | A1 | 4/2009 | Dean | |
| 2014/0253400 | A1* | 9/2014 | Tiezzi | H01Q 9/0457 343/770 |
| 2015/0194730 | A1* | 7/2015 | Sudo | H01Q 5/378 343/905 |
| 2016/0190697 | A1 | 6/2016 | Preradovic et al. | |
| 2016/0261039 | A1 | 9/2016 | Parsche | |
| 2019/0020110 | A1* | 1/2019 | Paulotto | H01Q 9/0414 |
| 2019/0020114 | A1* | 1/2019 | Paulotto | H01Q 1/243 |
| 2019/0027802 | A1* | 1/2019 | Noori | H01Q 21/065 |
| 2019/0229421 | A1 | 7/2019 | Onaka et al. | |
| 2020/0287298 | A1* | 9/2020 | Ueda | H01Q 9/0407 |
| 2020/0313299 | A1* | 10/2020 | Jia | H01Q 9/0414 |
| 2020/0403322 | A1* | 12/2020 | Ryu | H01Q 3/26 |
| 2021/0028535 | A1* | 1/2021 | Wu | H01Q 21/0075 |
| 2021/0057823 | A1* | 2/2021 | Zhang | H01Q 1/36 |
| 2021/0313703 | A1* | 10/2021 | Stanley | H01Q 1/52 |

FOREIGN PATENT DOCUMENTS

| | | | |
|---|---|---|---|
| CN | 104577343 | A | 4/2015 |
| CN | 104662737 | A | 5/2015 |
| CN | 105938940 | A | 9/2016 |
| CN | 106252893 | A | 12/2016 |
| CN | 106486766 | A | 3/2017 |
| CN | 106887722 | A | 6/2017 |
| EP | 2958190 | A1 | 12/2015 |
| WO | 2008030208 | A2 | 3/2008 |
| WO | 2018074378 | A1 | 4/2018 |

* cited by examiner

MILLIMETER-WAVE ANTENNA ARRAY ELEMENT, ARRAY ANTENNA, AND COMMUNICATIONS PRODUCT

CROSS-REFERENCE TO RELATED APPLICATIONS

This application is a U.S. National Stage of International Patent Application No. PCT/CN2018/086197 filed on May 9, 2018, which is hereby incorporated by reference in its entirety.

TECHNICAL FIELD

The present invention relates to the field of antenna technologies, and in particular, to a dual-band dual-polarized millimeter-wave antenna.

BACKGROUND

With development of the fifth generation mobile communications technology, a millimeter-wave frequency band is formally used. For example, two millimeter-wave frequency bands in the United States are respectively 28 GHz and 39 GHz. To meet operators' requirements, antennas of communications products (such as smart phones and notebook computers) should cover both the millimeter-wave frequency bands. However, so far, there is no design of a dual-band dual-polarized millimeter-wave antenna in the industry.

SUMMARY

Embodiments of this application provide a design of a dual-band dual-polarized millimeter-wave antenna.

According to a first aspect, this application provides a millimeter-wave antenna array element, including a ground layer, a first dielectric layer, a first radiation patch, a second dielectric layer, and a second radiation patch that are sequentially stacked, the millimeter-wave antenna array element further includes a first feeding part and a second feeding part; at least a part of the first feeding part is disposed inside the first dielectric layer, or inside the second dielectric layer, or between the first dielectric layer and the second dielectric layer, and the first feeding part is insulated from the first radiation patch, the second radiation patch, and the ground layer; at least a part of the second feeding part is disposed inside the first dielectric layer, or inside the second dielectric layer, or between the first dielectric layer and the second dielectric layer, and the second feeding part is insulated from the first feeding part, the first radiation patch, the second radiation patch, and the ground layer; and the first feeding part and the second feeding part are electrically connected to a feed, to excite electromagnetic wave signals of two frequency bands to each of the first radiation patch and the second radiation patch. Specifically, the electromagnetic wave signals are excited through spatial coupling. In addition, electromagnetic wave signals with two polarizations are generated on each of the first radiation patch and the second radiation patch. In other words, electromagnetic wave signals with two polarizations are generated on the first radiation patch. Specifically, orthogonally polarized electromagnetic wave signals are generated on the first radiation patch, and orthogonally polarized electromagnetic wave signals are also generated on the second radiation patch.

For example, the electromagnetic wave signals of the two frequency bands may be electromagnetic wave signals of a frequency band range of 26.5 GHz to 29.5 GHz and electromagnetic wave signals of a frequency band range of 37.0 GHz to 40.5 GHz.

In this application, the first feeding part and the second feeding part are disposed, the first feeding part is spatially coupled to the first radiation patch and the second radiation patch, and the second feeding part is spatially coupled to the first radiation patch and the second radiation patch, so that electromagnetic wave signals with two different polarizations of a first frequency band are excited on the first radiation patch, and electromagnetic wave signals with two different polarizations of a second frequency band are excited on the second radiation patch. In this way, the millimeter-wave antenna array element provided in this application can be dual-band and dual-polarized. Specifically, a frequency of an electromagnetic wave signal on the first radiation patch is lower than a frequency of an electromagnetic wave signal on the second radiation patch, the first radiation patch is a low-frequency radiator, and the second radiation patch is a high-frequency radiator.

In an implementation, when at least a part of the first feeding part and at least a part of the second feeding part are disposed between the first dielectric layer and the second dielectric layer, the first feeding part includes a first feeding plate and a first conducting wire, the second feeding part includes a second feeding plate and a second conducting wire, a first accommodation hole and a second accommodation hole are disposed on the first radiation patch, the first feeding plate is disposed in the first accommodation hole, the second feeding plate is disposed in the second accommodation hole, the first conducting wire is electrically connected between the first feeding plate and the feed, and the second conducting wire is electrically connected between the second feeding plate and the feed. In this implementation, the first feeding plate and the second feeding plate are disposed at the same layer as the first radiation patch. In this way, only one dielectric layer needs to be disposed between the first radiation patch and the ground layer, and only one dielectric layer needs to be disposed between the second radiation patch and the first radiation patch. This helps reduce an overall size of the millimeter-wave antenna array element. In this architecture, it is equivalent that the millimeter-wave antenna array element provided in this application is disposed on a double-layer PCB, and the double-layer PCB has two dielectric layers (namely, the first dielectric layer and the second dielectric layer) and three metal layers (namely, the ground layer, the first radiation patch, and the second radiation patch). Specifically, the first feeding plate and the second feeding plate may be in any shape such as a circle, a triangle, or a square.

In another implementation, the first feeding plate and the second feeding plate may alternatively be disposed in other locations, for example, embedded in the first dielectric layer. In other words, a metal layer is further disposed inside the first dielectric layer. In this way, it is equivalent that the millimeter-wave antenna array element in this application is disposed on a multi-layer PCB. Certainly, the first feeding plate and the second feeding plate may alternatively be embedded in the second dielectric layer. Alternatively, the first feeding plate and the second feeding plate are respectively disposed inside the first dielectric layer and the second dielectric layer. That is, the first feeding plate and the second feeding plate may be disposed at different layers.

In an implementation, the first conducting wire vertically extends from the first feeding plate to the ground layer, and extends out of the millimeter wave array element from the ground layer, and the second conducting wire vertically extends from the second feeding plate to the ground layer, and extends out of the millimeter wave array element from the ground layer. Lead-out directions of the first conducting wire and the second conducting wire are limited in this implementation. This architecture helps reduce impact of the first feeding part and the second feeding part on antenna radiation performance, reduce a feeding loss, and improve an antenna gain.

The first conducting wire and the second conducting wire may be coaxial cables. An inner conductor of the coaxial cable extends into the first dielectric layer and is electrically connected to the first feeding plate, and an outer conductor of the coaxial cable is electrically connected to the ground layer. Specifically, openings may be disposed at the ground layer and the first dielectric layer, and the openings extend from the ground layer to the first feeding plate. In this way, the first conducting wire and the second conducting wire may extend into the openings and be electrically connected to the first feeding plate and the seconding feeding plate.

In an implementation, the first radiation patch is symmetrically distributed along both a first axis and a second axis, the first axis is perpendicular to the second axis, and the first feeding plate and the second feeding plate are respectively disposed on the first axis and the second axis.

In an implementation, a center of the second radiation patch faces a center of the first radiation patch, and an area of the second radiation patch is less than an area of the first radiation patch. An outline of the first radiation patch is a cross shape, and the outline of the first radiation patch includes four straight line edges located on four sides and four ⌊-shaped edges that are each connected between two adjacent straight line edges and that are located at four corners. An outline of the second radiation patch includes four side edges of a same shape that are located on four sides and that are sequentially connected. Each side edge includes one straight line edge and two L-shaped edges, the two L-shaped edges are bilaterally symmetrical on two sides of the straight line edge, and L-shaped edges of two adjacent side edges are connected. A through hole is disposed in a center area of the second radiation patch. In a specific implementation, the through hole may be but is not limited to a circle. Specific shape structures of the first radiation patch and the second radiation patch are not limited to those described in this implementation, and shapes of the first radiation patch and the second radiation patch may change based on a specific antenna matching requirement.

In an implementation, the millimeter-wave antenna array element further includes one or more resonators, the one or more resonators are distributed on a periphery of the second radiation patch and are insulated from the second radiation patch, and the one or more resonators are configured to improve isolation and a spread bandwidth of the millimeter-wave antenna array element.

In an implementation, there are four resonators, and the resonators are distributed pairwise opposite to each other on four sides of the second radiation patch.

In an implementation, each resonator is in a strip shape, an extension direction of two resonators that are disposed opposite to each other is a first direction, and an extension direction of the other two resonators that are disposed opposite to each other is a second direction. The first direction is perpendicular to the second direction, and in the first direction and the second direction, a size of the second radiation patch is less than or equal to an extension size of each resonator. In other words, a vertical projection of the second radiation patch on the resonator coincides with the resonator or falls within a range of the resonator.

According to a second aspect, this application provides an array antenna, including a plurality of millimeter-wave antenna array elements according to the first aspect. The plurality of millimeter-wave antenna array elements are distributed in an array, all the first dielectric layers are coplanar and jointly form a complete dielectric slab, all the second dielectric layers are coplanar and jointly form a complete dielectric slab, and all the ground layers are coplanar and interconnected as a whole.

In an implementation, the array antenna further includes an isolation structure, the isolation structure is disposed between adjacent millimeter-wave antenna array elements, the isolation structure includes an isolation plate and a plurality of metal through holes, the isolation plate is disposed on a side that is of the second dielectric layers and that is away from the first dielectric layers, the isolation plate is disposed between adjacent second radiation patches, and the plurality of metal through holes extend from the isolation plate to the ground layers.

In an implementation, in a direction perpendicular to the second dielectric layers, a height at which the isolation plate protrudes from the second dielectric layers is greater than a height at which the second radiation patches protrude from the second dielectric layers.

According to a third aspect, this application provides a communications product, including a feed source and the array antenna according to the second aspect, and the feed source is configured to feed electromagnetic wave signals into the first feeding part and the second feeding part.

DESCRIPTION OF EMBODIMENTS

The following describes the embodiments of this application with reference to accompanying drawings.

Figure 1:
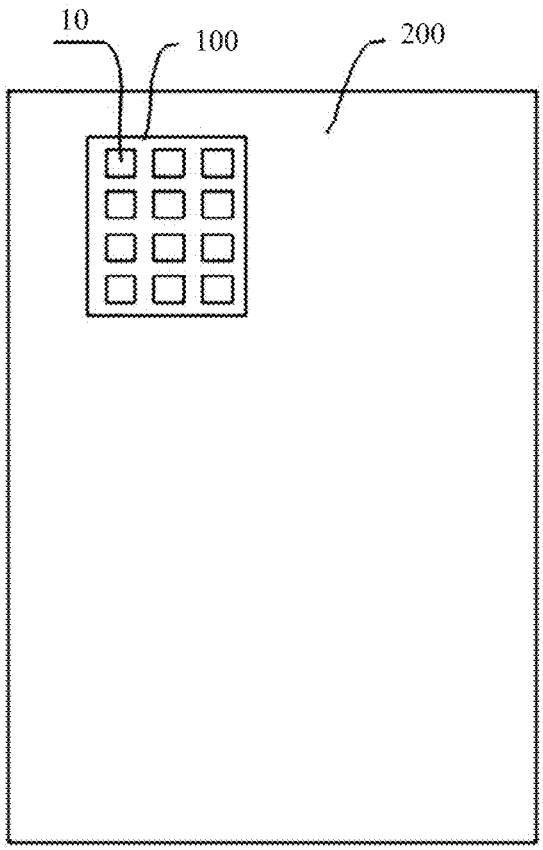
FIG. 1 is a schematic diagram of a communications product including a millimeter-wave antenna array element according to an implementation of this application.

A millimeter-wave antenna array element and an array antenna provided in this application are applied to a communications product. The communications product may be a mobile terminal such as a mobile phone operating within a millimeter-wave frequency band range of a 5G communications system. As shown in FIG. 1, an antenna 100 is disposed on the back of a communications product 200 (for example, a mobile phone), and signal receiving and sending may be implemented by using a rear housing of the communications product 200 or a gap on the rear housing. The antenna 100 includes a plurality of antenna array elements 10 arranged in an array, and each antenna array element 10 is a millimeter-wave antenna array element.

Figure 2:
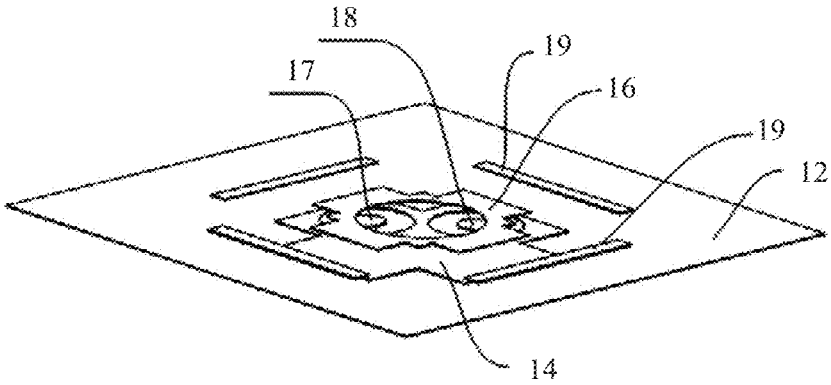
FIG. 2 is a three-dimensional schematic diagram of a millimeter-wave antenna array element without a first dielectric layer and a second dielectric layer according to an implementation of this application.
Figure 3:
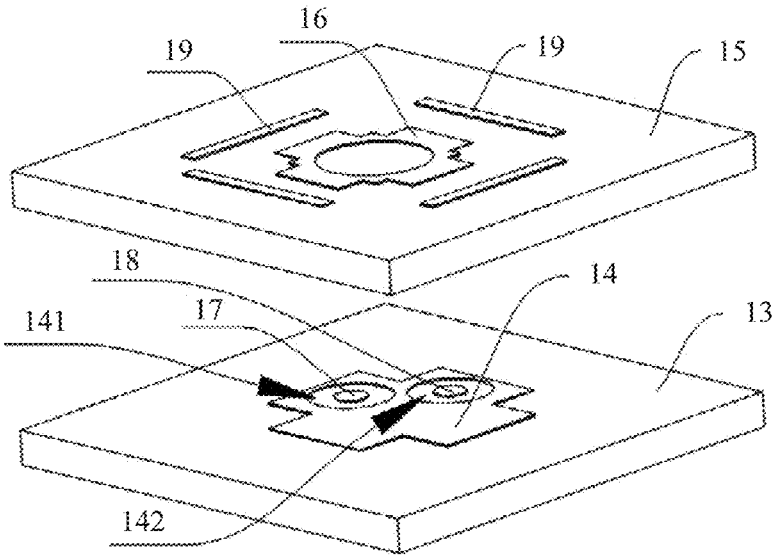
FIG. 3 is a three-dimensional exploded schematic diagram of a millimeter-wave antenna array element in which a first dielectric layer and a second dielectric layer are separated according to an implementation of this application.
Figure 4:
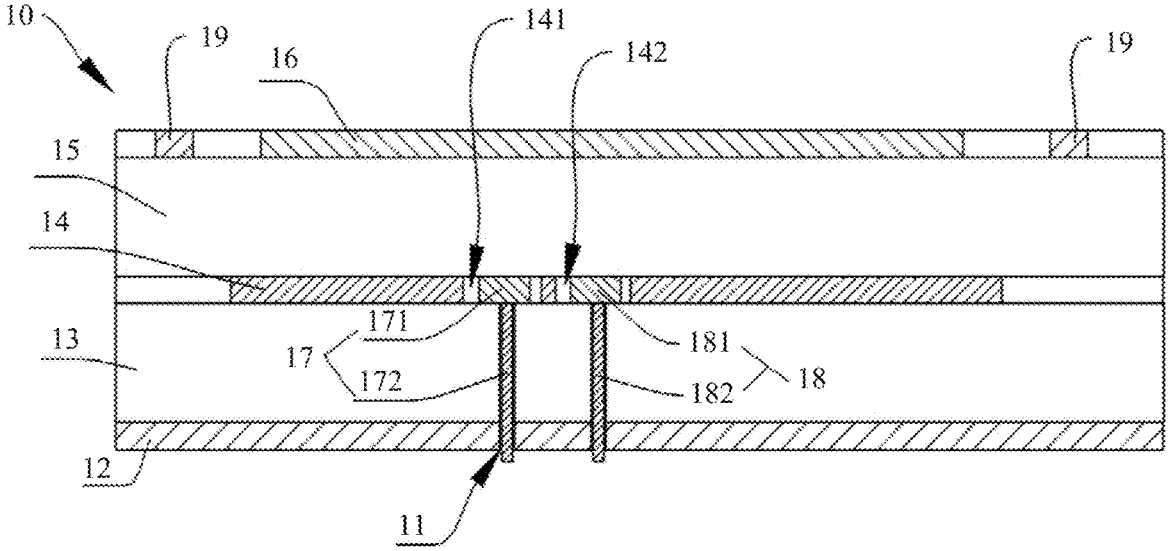
FIG. 4 is a schematic diagram of a cross section of a millimeter-wave antenna array element according to an implementation of this application.

Referring to FIG. 2, FIG. 3, and FIG. 4, a millimeter-wave antenna array element 10 provided in an implementation of this application includes a ground layer 12, a first dielectric layer 13, a first radiation patch 14, a second dielectric layer 15, and a second radiation patch 16 that are sequentially stacked. The first dielectric layer 13 and the second dielectric layer 15 are base material layers, and are configured to carry the ground layer 12, the first radiation patch 14, and the second radiation patch 16. The first dielectric layer 13 and the second dielectric layer 15 may be of insulation materials such as a PCB base material and a ceramic base material. In another implementation, the first dielectric layer 13 and the second dielectric layer 15 may alternatively be of a flexible material. In a specific implementation, the first dielectric layer 13 and the second dielectric layer 15 are dielectrics.

The millimeter-wave antenna array element 10 further includes a first feeding part 17 and a second feeding part 18. At least a part of the first feeding part 17 is disposed inside the first dielectric layer 13, or inside the second dielectric layer 15, or between the first dielectric layer 13 and the second dielectric layer 15. The first feeding part 17 is insulated from the first radiation patch 14, the second radiation patch 16, and the ground layer 12. At least a part of the second feeding part 18 is disposed inside the first dielectric layer 13, or inside the second dielectric layer 15, or between the first dielectric layer 13 and the second dielectric layer 15. The second feeding part 18 is insulated from the first feeding part 17, the first radiation patch 14, the second radiation patch 16, and the ground layer 12. Specifically, in an implementation, being insulated herein means that features are insulated through isolation of dielectrics, and the dielectrics may be the first dielectric layer 13 and the second dielectric layer 15.

The first feeding part 17 and the second feeding part 18 may be disposed at a same layer, or may be disposed at different layers. The first feeding part 17 and the second feeding part 18 are electrically connected to a feed, to excite electromagnetic wave signals of two frequency bands to each of the first radiation patch 14 and the second radiation patch 16 through spatial coupling, and generate electromagnetic wave signals with two polarizations on each of the first radiation patch 14 and the second radiation patch 16. In other words, electromagnetic wave signals with two polarizations are generated on the first radiation patch 14. Specifically, orthogonally polarized electromagnetic wave signals are generated on the first radiation patch 14, and orthogonally polarized electromagnetic wave signals are also generated on the second radiation patch 16.

For example, the electromagnetic wave signals of the two frequency bands may be electromagnetic wave signals of a frequency band range of 26.5 GHz to 29.5 GHz and electromagnetic wave signals of a frequency band range of 37.0 GHz to 40.5 GHz.

In this application, the first feeding part 17 and the second feeding part 18 are disposed, the first feeding part 17 is spatially coupled to the first radiation patch 14 and the second radiation patch 16, and the second feeding part 18 is spatially coupled to the first radiation patch 14 and the second radiation patch 16, so that electromagnetic wave signals with two different polarizations of a first frequency band are excited on the first radiation patch 14, and electromagnetic wave signals with two different polarizations of a second frequency band are excited on the second radiation patch 16. In this way, the millimeter-wave antenna array element provided in this application can be dual-band and dual-polarized. Specifically, a frequency of an electromagnetic wave signal on the first radiation patch 14 is lower than a frequency of an electromagnetic signal on the second radiation patch 16, that is, the first radiation patch 14 is a low-frequency radiator, and the second radiation patch 16 is a high-frequency radiator.

A thickness of the first dielectric layer 13 is greater than a thickness of the second dielectric layer 15. Herein, the "thickness" is a size in a direction perpendicular to the first dielectric layer 13 and the second dielectric layer 15. In a specific implementation, a vertical distance between the first radiation patch 14 and the ground layer 12 is 0.7 mm, and a vertical distance between the second radiation patch 16 and the ground layer 12 is 0.9 mm.

Specifically, the ground layer 12 is a metal layer formed on a bottom surface of the first dielectric layer 13. The ground layer 12 may be a large-area copper foil layer that covers all the bottom surface of the first dielectric layer 13, or the ground layer 12 may cover only a part of the bottom surface of the first dielectric layer 13. The first radiation patch 14 is a metal layer formed on a top surface of the first dielectric layer 13, the first radiation patch 14 is sandwiched between the first dielectric layer 13 and the second dielectric layer 15, and the second radiation patch 16 is a metal layer formed on a top surface of the second dielectric layer 15.

In an implementation, the first feeding part 17 includes a first feeding plate 171 and a first conducting wire 172, and the second feeding part 18 includes a second feeding plate 181 and a second conducting wire 182. A first accommodation hole 141 and a second accommodation hole 142 are disposed on the first radiation patch 14, the first feeding plate 171 is disposed in the first accommodation hole 141, and the second feeding plate 181 is disposed in the second accommodation hole 142. The first conducting wire 172 is electrically connected between the first feeding plate 171 and the feed, and the second conducting wire 182 is electrically connected between the second feeding plate 181 and the feed. In this implementation, the first feeding plate 171 and the second feeding plate 181 are disposed at the same layer as the first radiation patch 14. In this way, only one dielectric layer needs to be disposed between the first radiation patch 14 and the ground layer 12, and only one dielectric layer needs to be disposed between the second radiation patch 16 and the first radiation patch 14. This helps reduce an overall size of the millimeter-wave antenna array element. In this architecture, it is equivalent that the millimeter-wave antenna array element provided in this application is disposed on a double-layer PCB, and the double-layer PCB has two dielectric layers (namely, the first dielectric layer 13 and the second dielectric layer 15) and three metal layers (namely, the ground layer 12, the first radiation patch 14, and the second radiation patch 16). Specifically, the first feeding plate 171 and the second feeding plate 181 may be in any shape such as a circle, a triangle, or a square.

In another implementation, the first feeding plate 171 and the second feeding plate 181 may alternatively be disposed in other locations, for example, embedded in the first dielectric layer 13. In other words, a metal layer is further disposed inside the first dielectric layer 13. In this way, it is equivalent that the millimeter-wave antenna array element in this application is disposed on a multi-layer PCB. Certainly, the first feeding plate 171 and the second feeding plate 181 may alternatively be embedded in the second dielectric layer 15. Alternatively, the first feeding plate 171 and the second feeding plate 181 are respectively disposed inside the first dielectric layer 13 and the second dielectric layer 15. That is, the first feeding plate 171 and the second feeding plate 181 may be disposed at different layers.

In an implementation, the first conducting wire 172 vertically extends from the first feeding plate 171 to the ground layer 12, and extends out of the millimeter wave array element 10 from the ground layer 12, and the second conducting wire 182 vertically extends from the second feeding plate 181 to the ground layer 12, and extends out of the millimeter wave array element 10 from the ground layer 12. Lead-out directions of the first conducting wire 172 and the second conducting wire 182 are limited in this implementation. This architecture helps reduce impact of the first feeding part 17 and the second feeding part 18 on antenna radiation performance, reduce a feeding loss, and improve an antenna gain.

The first conducting wire 172 and the second conducting wire 182 may be coaxial cables. An inner conductor of the coaxial cable extends into the first dielectric layer 13 and is electrically connected to the first feeding plate 171, and an outer conductor of the coaxial cable is electrically connected to the ground layer 12. Specifically, two openings 11 may be disposed at the ground layer 12 and the first dielectric layer 13. As shown in FIG. 3, the openings 11 extend from the ground layer 12 to the first feeding plate 171 and the second feeding plate 181. In this way, the first conducting wire 172 and the second conducting wire 182 may extend into the openings 11 and be electrically connected to the first feeding plate 171 and the seconding feeding plate 181. A diameter of the opening 11 at the ground layer 12 may be greater than a diameter of the opening 11 at the first dielectric layer 13. In this way, the first conducting wire 172 and the second conducting wire 182 can easily extend into the openings 11.

The first conducting wire 172 and the second conducting wire 182 may alternatively be probes or other feeding structures.

Figure 5:
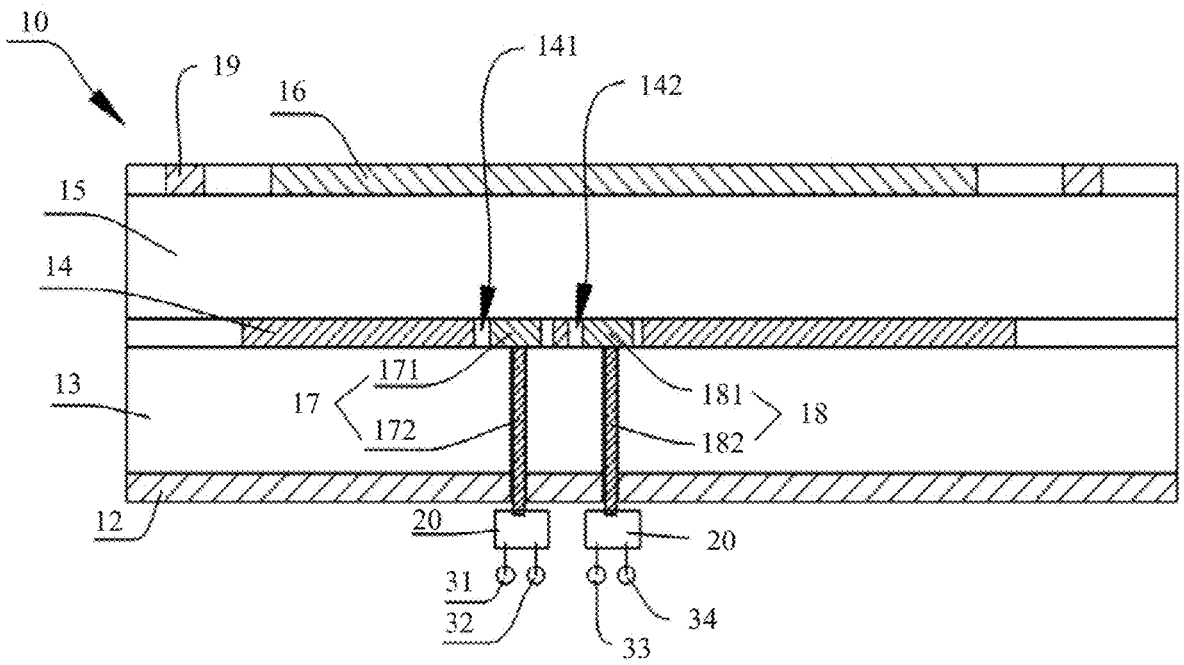
FIG. 5 is a schematic diagram of a cross section of a millimeter-wave antenna array element in which a feed and a duplex circuit structure are added according to an implementation of this application.

As shown in FIG. 5, in an implementation, the first conducting wire 172 and the second conducting wire 182 each are connected to the feed through a duplexer (or a duplex circuit) 20. The feed has two ports for inputting to the duplexer, and the ports each are configured to input electromagnetic wave signals of a different frequency band. In an implementation, an input end of a duplexer 20 connected to the first conducting wire 172 includes a first port 31 and a second port 32, and an input end of a duplexer 20 connected to the second conducting wire 182 includes a third port 33 and a fourth port 34. The first port 31 and the third port 33 are configured to perform low-frequency feeding, and the second port 32 and the fourth port 34 are configured to perform high-frequency feeding.

Figure 6:
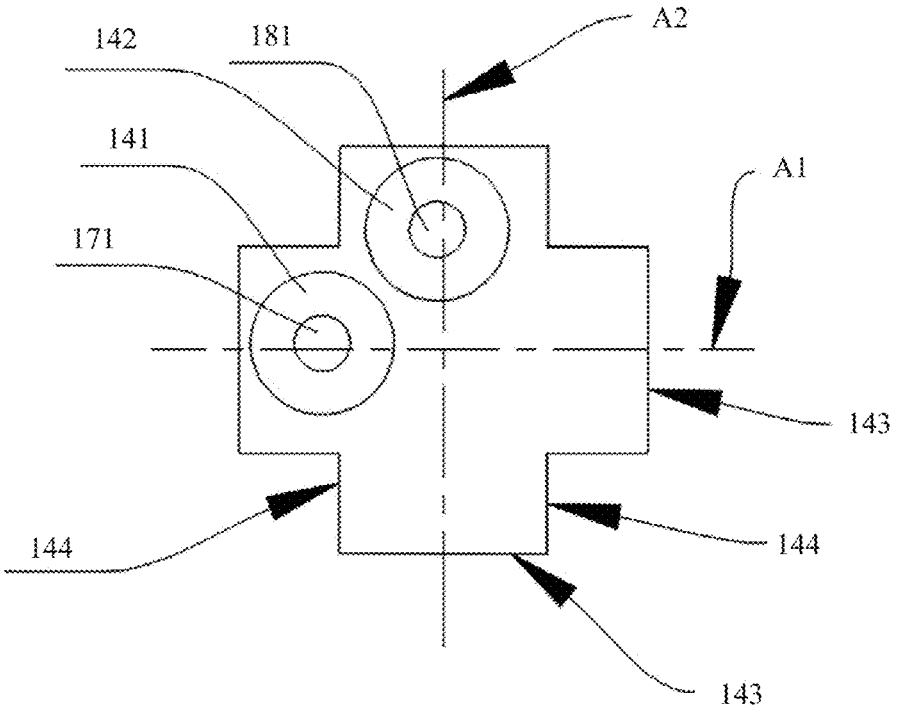
FIG. 6 is a schematic planar diagram of a first radiation patch of a millimeter-wave antenna array element according to an implementation of this application.

As shown in FIG. 6, in an implementation, the first radiation patch 14 is symmetrically distributed along both a first axis A1 and a second axis A2, and the first axis A1 is perpendicular to the second axis A2. The first feeding plate 171 and the second feeding plate 181 are respectively disposed on the first axis A1 and the second axis A2. In other words, the first axis A1 passes through the first feeding plate 171, and the second axis A2 passes through the second feeding plate 181. In this way, the millimeter-wave antenna array element can enable two polarizations of electromagnetic wave signals to be in an orthogonal mode. Specifically, a center of the first feeding plate 171 may be disposed on the first axis A1, and a center of the second feeding plate 181 may be disposed on the second axis A2. A specific location of the first feeding plate 171 on the first axis A1 and a specific location of the second feeding plate 181 on the second axis A2 are determined based on matching performance of the millimeter-wave antenna array element. However, sometimes, due to a matching requirement, the two feeding radiation plates (171 and 181) do not necessarily need to be disposed on the axes (A1 and A2).

In an implementation, a center of the second radiation patch 16 faces a center of the first radiation patch 14, and an area of the second radiation patch 16 is less than an area of the first radiation patch 14. An outline of the first radiation patch 14 is a cross shape, and the outline of the first radiation patch 14 includes four straight line edges 143 located on four sides and four ⌊-shaped edges 144 that are each connected between two adjacent straight line edges 143 and that are located at four corners.

Figure 7:
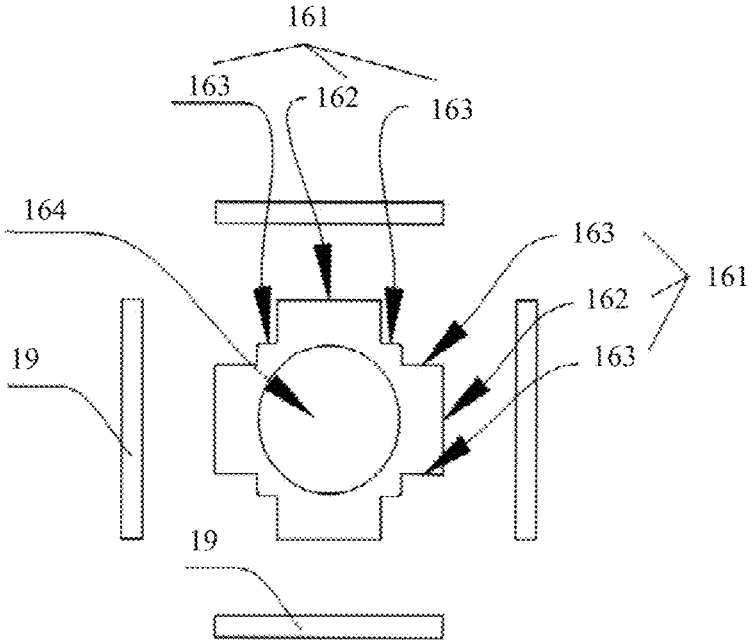
FIG. 7 is a schematic planar diagram of a second radiation patch of a millimeter-wave antenna array element according to an implementation of this application.

As shown in FIG. 7, an outline of the second radiation patch 16 includes four side edges 161 of a same shape that are located on four sides and that are sequentially connected. Each side edge includes one straight line edge 162 and two L-shaped edges 163, the two L-shaped edges 163 are bilaterally symmetrical on two sides of the straight line edge 162, and L-shaped edges 163 of two adjacent side edges 161 are connected. A through hole 164 is disposed in a center area of the second radiation patch 16. In a specific implementation, the through hole 164 may be but is not limited to a circle.

Specific shape structures of the first radiation patch 14 and the second radiation patch 16 are not limited to those described in this implementation, and shapes of the first radiation patch 14 and the second radiation patch 16 may change based on a specific antenna matching requirement.

In an implementation, the millimeter-wave antenna array element 10 further includes one or more resonators 19, the one or more resonators 19 are distributed on a periphery of the second radiation patch 16 and are insulated from the second radiation patch 16, and the one or more resonators 19 are configured to improve isolation and a spread bandwidth of the millimeter-wave antenna array element 10.

In an implementation, there are four resonators 19, and the resonators are distributed pairwise opposite to each other on four sides of the second radiation patch 16.

In an implementation, each resonator 19 is in a strip shape, an extension direction of two resonators 19 that are disposed opposite to each other is a first direction, and an extension direction of the other two resonators 19 that are disposed opposite to each other is a second direction. The first direction is perpendicular to the second direction, and in the first direction and the second direction, a size of the second radiation patch 16 is less than or equal to an extension size of each resonator 19. In the first direction and the second direction, a center of the second radiation patch 16 faces a center of the resonator 19. In this way, an orthographic projection of the second radiation patch 16 on any resonator 19 falls within a range of the resonator 19 or coincides with the resonator 19. This architecture herein helps improve isolation between millimeter-wave antenna array elements.

Figure 8:
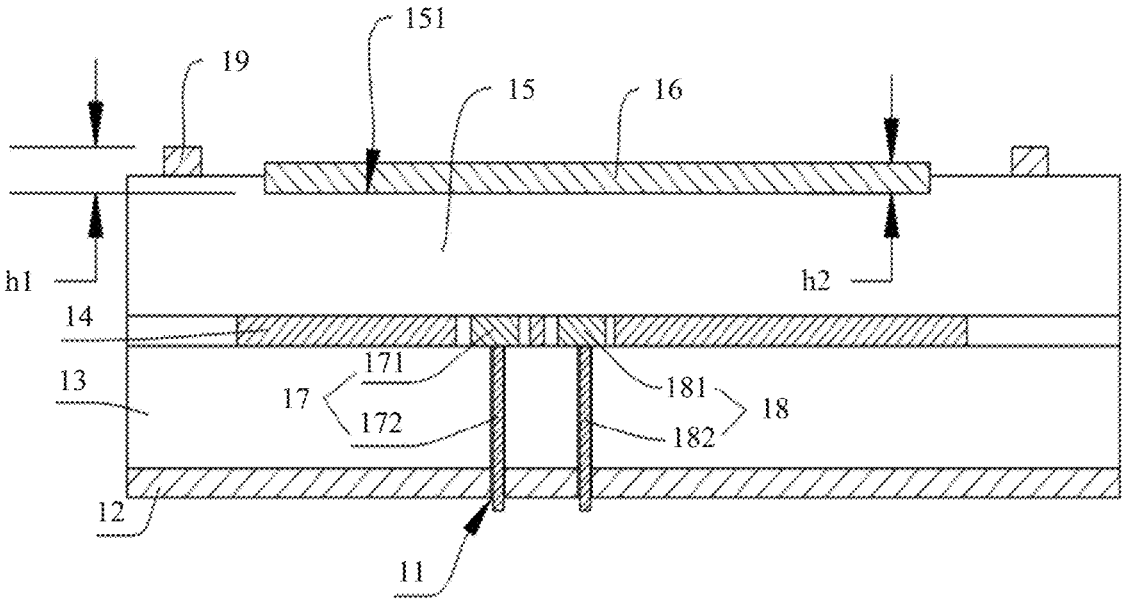
FIG. 8 is a schematic diagram of a cross section of a millimeter-wave antenna array element according to an implementation of this application.

As shown in FIG. 8, in an implementation, an area that is on a surface of the second dielectric layer 15 and that is used to adhere to the second radiation patch 16 is used as a reference surface 151. A height h1 at which the resonators 19 that are disposed on four sides of the second radiation patch 16 protrude from the reference surface 151 is greater than a height h2 at which the second radiation patch 16 protrudes from the reference surface 151. In this way, an isolation effect can be better improved. Specifically, a groove may be disposed on the top surface of the second dielectric layer 15, a shape of the groove is consistent with a shape of the second radiation patch 16, the second radiation patch 16 is disposed in the groove, and a bottom surface of the groove is the reference surface 151.

An array antenna provided in this application includes a plurality of millimeter-wave antenna array elements distributed in an array. All the first dielectric layers 13 are coplanar and jointly form a complete dielectric slab, all the second dielectric layers 15 are coplanar and jointly form a complete dielectric slab, and all the ground layers 12 are coplanar and interconnected as a whole. In other words, the array antenna includes a first dielectric slab and a second dielectric slab that are stacked, a bottom surface of the first dielectric slab is the ground layers 12, a plurality of first radiation patches 14 arranged in an array are disposed on a top surface of the first dielectric slab, and a plurality of second radiation patches 16 arranged in an array and the resonators 19 arranged around each second radiation patch 16 are disposed on a top surface (to be specific, a surface that is of the second dielectric slab and that is away from the first dielectric slab) of the second dielectric slab. Each second radiation patch 16 is disposed opposite to each first radiation patch 14. The first radiation patch 14, the second radiation patch 16, the resonators 19 around the second radiation patch 16, and a part of the ground layers 12 facing the first radiation patch 14 jointly form a millimeter-wave antenna array element.

Figure 9:
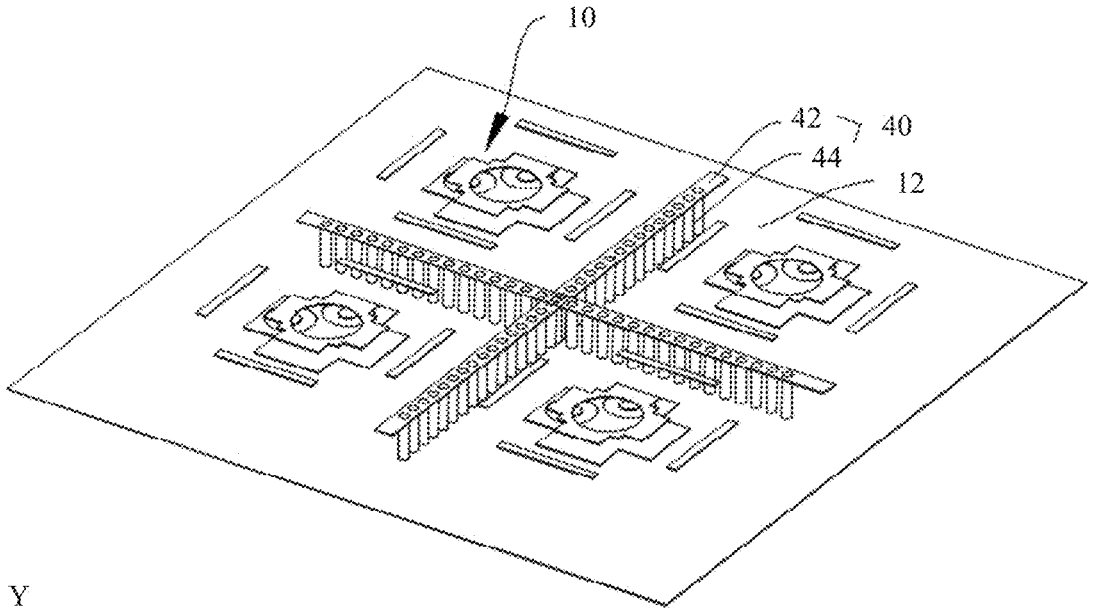
FIG. 9 is a schematic diagram of an array antenna (a 2×2 array) according to an implementation of this application.
Figure 10:
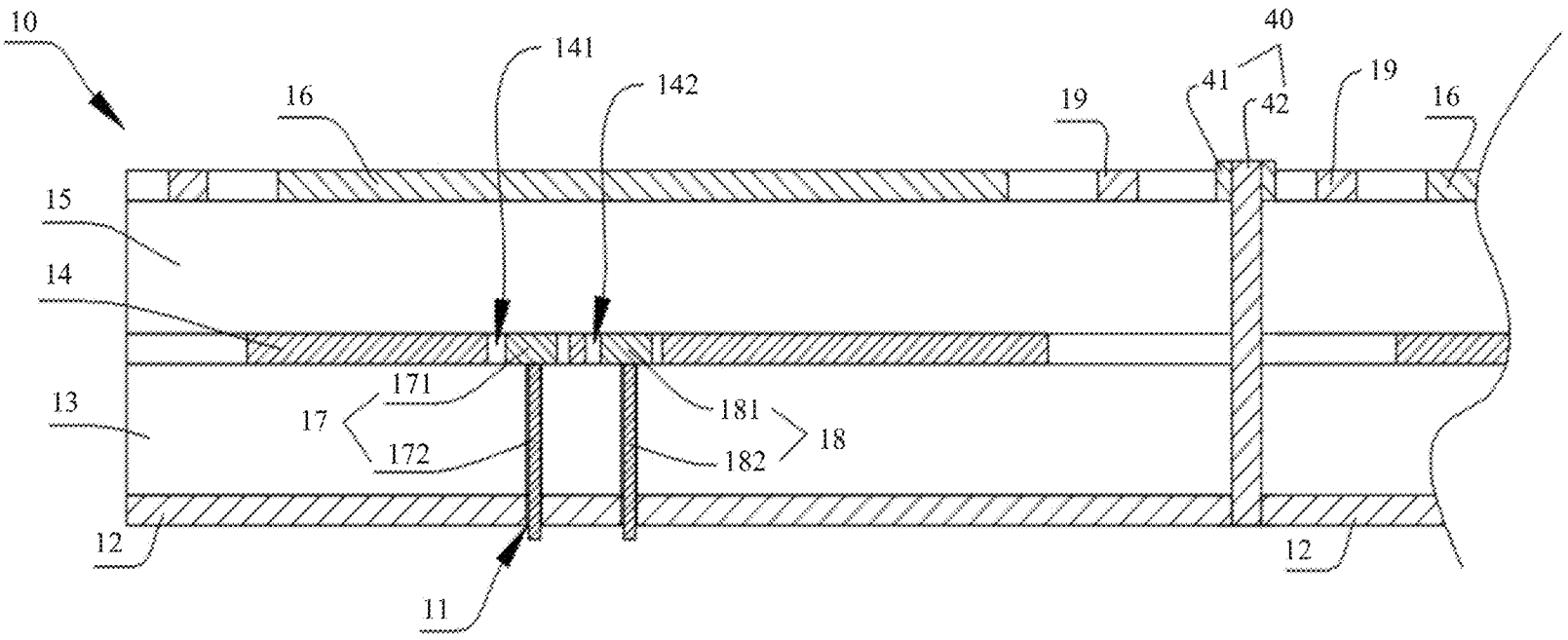
FIG. 10 is a schematic diagram of a cross section of an array antenna according to an implementation of this application.

As shown in FIG. 9 and FIG. 10, in an implementation, the antenna further includes an isolation structure 40. The isolation structure 40 is disposed between adjacent millimeter-wave antenna array elements 10. The isolation structure 40 includes an isolation plate 41 and a plurality of metal through holes 42. The isolation plate 41 is disposed on a side that is of the second dielectric layers 15 and that is away from the first dielectric layers 13. In other words, the isolation plate 41 is located on a side: a top surface of the second dielectric layers 15. Specifically, the isolation plate 41 may be directly disposed on the top surface of the second dielectric layers 15. The isolation plate 41 is disposed between adjacent second radiation patches 16, and the plurality of metal through holes 42 extend from the isolation plate 41 to the ground layers 12. In the array antenna, the isolation structure 40 disposed between millimeter-wave antenna array elements that are distributed in a 2×2 array is in a cross shape. That is, the isolation plate 41 is in a cross shape, four quadrants are obtained through division by using the isolation plate 41, and each millimeter-wave antenna array element 10 is disposed in one quadrant.

In an implementation, in a direction perpendicular to the second dielectric layers 15, a height at which the isolation plate protrudes from the second dielectric layers 15 is greater than a height at which the second radiation patches 16 protrude from the second dielectric layers 15. The isolation plate 41 may be a metal plate fastened on the top surface of the second dielectric layers 15, or may be a metal layer formed on the top surface of the second dielectric layers 15 by using a PCB manufacturing process.

Figure 11:
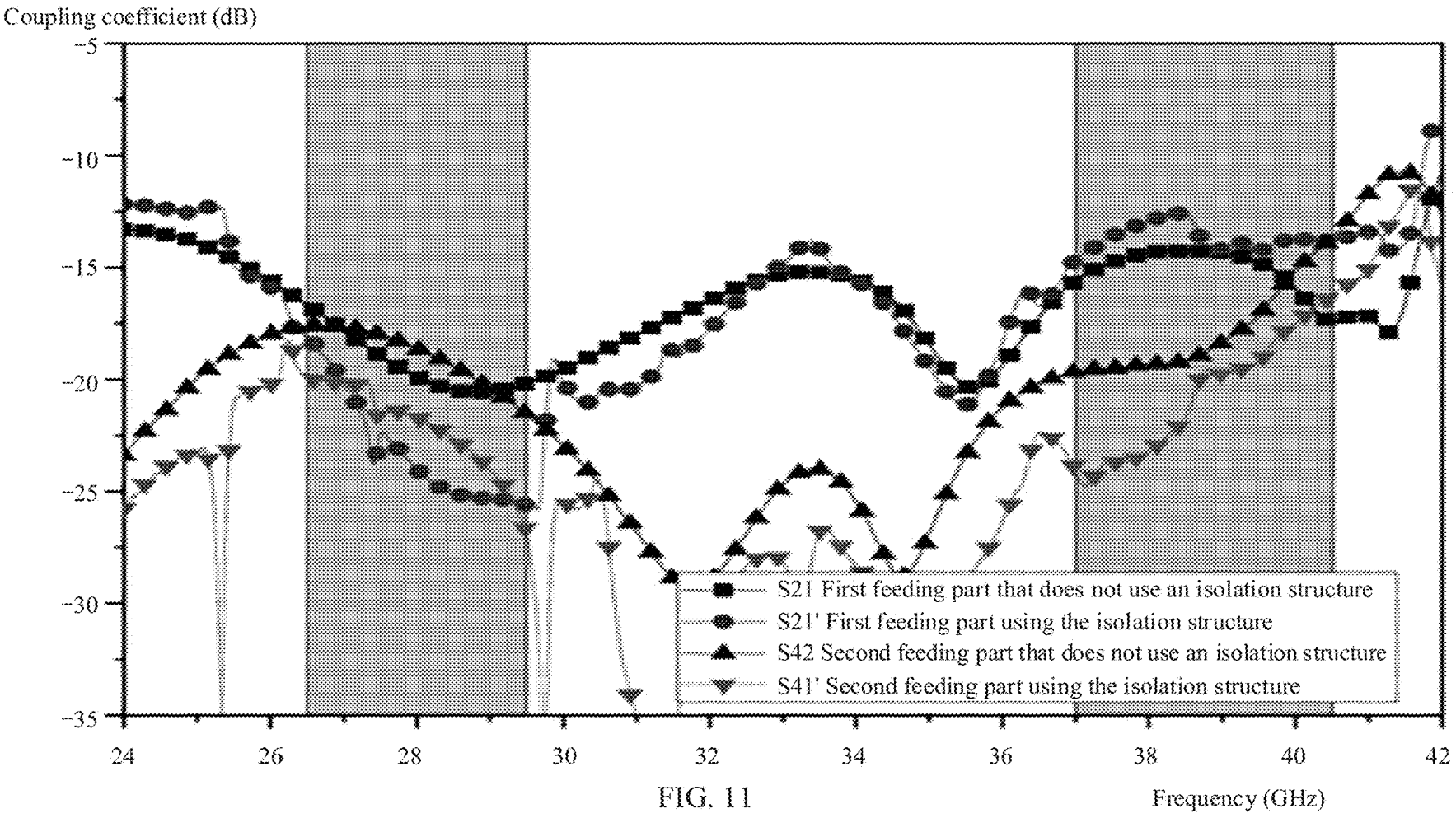
FIG. 11 is a schematic diagram of curves of isolation obtained before and after an array antenna uses an isolation structure according to this application.

FIG. 11 shows isolation between two feeding parts (a first feeding part 17 and a second feeding part 18) of an antenna using the isolation structure 40 and an antenna that does not use the isolation structure 40. S21 is a coupling coefficient of the first feeding part 17 of the antenna that does not use the isolation structure 40, S21' is a coupling coefficient of the first feeding part 17 of the antenna using the isolation structure 40, S41 is a coupling coefficient of the second feeding part 18 of the antenna that does not use the isolation structure 40, and S41' is a coupling coefficient of the second feeding part 18 of the antenna using the isolation structure 40. It can be learned from FIG. 11 that isolation of an antenna is improved after the isolation structure is used.

Figure 12:
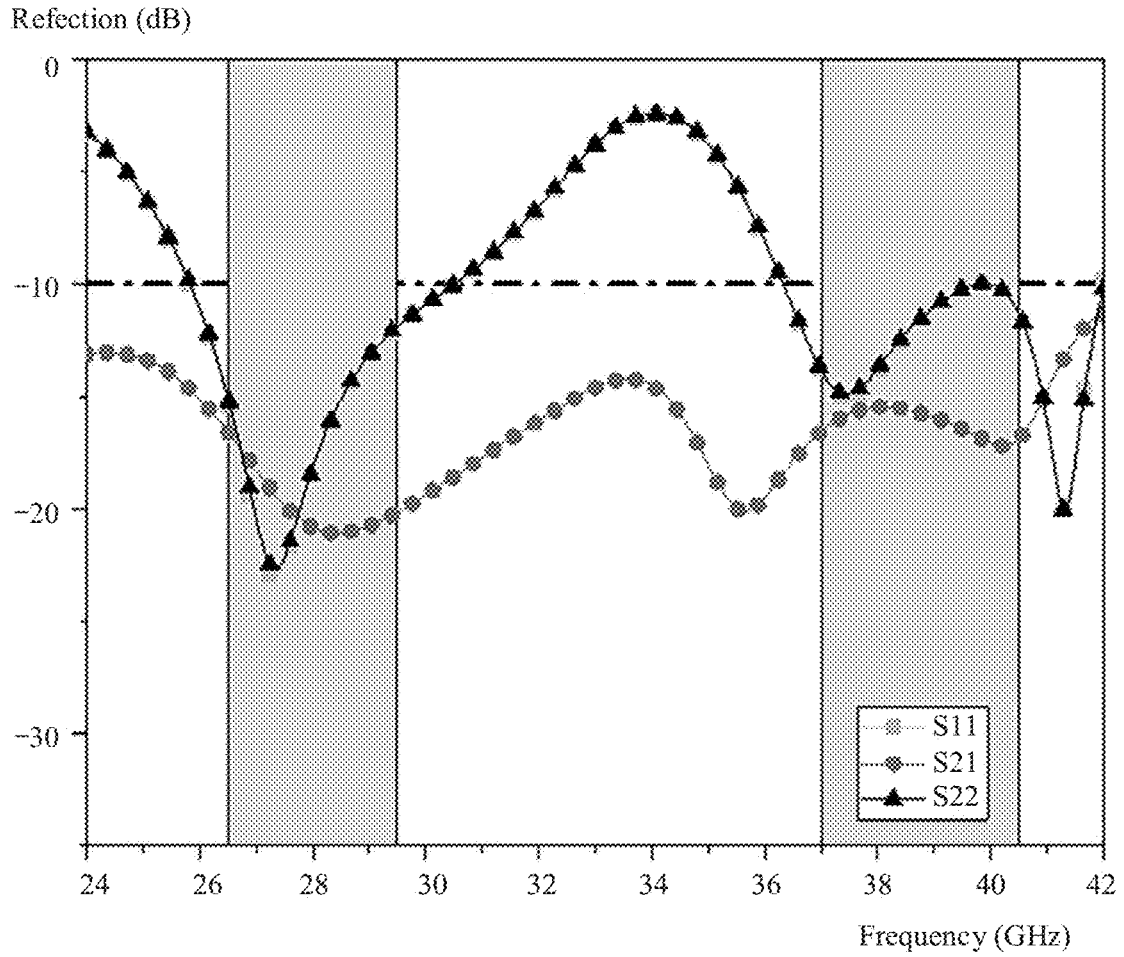
FIG. 12 is a system performance diagram of an array antenna according to this application.

FIG. 12 is a system performance diagram of an antenna according to this application. S11 and S22 respectively represent reflection of the first feeding part 17 and the second feeding part 18. It can be learned from the figure that values of S11 and S22 in both a high frequency band and a low frequency band are less than −10 dB. −10 dB is an acceptable value in terms of antenna performance. S21 represents isolation between the first feeding part 17 and the second feeding part 18. It can be learned from the figure that values of S21 in both the high frequency band and the low frequency band are less than −15 dB. −15 dB is an acceptable value in terms of antenna performance. This meets an antenna design requirement.

Figure 13:
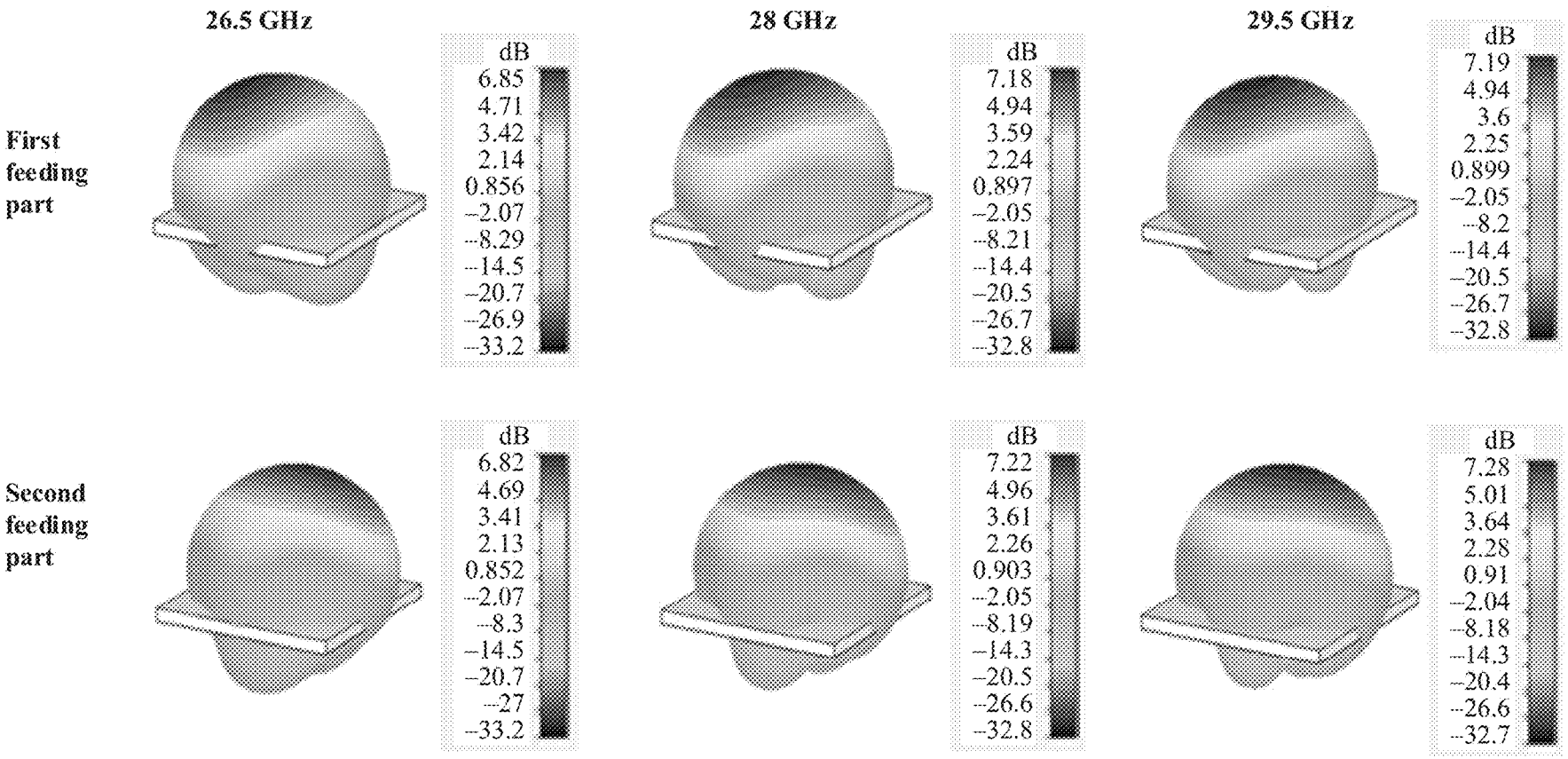
FIG. 13 is a radiation diagram of a millimeter-wave antenna array element in a low frequency band according to this application.

FIG. 13 is a radiation diagram of a millimeter-wave antenna array element in a low frequency band according to this application. As shown in the figure, a direction of maximum radiation energy is perpendicular to a plane of a radiator, and a radiation side lobe value meets a design requirement.

Figure 14:
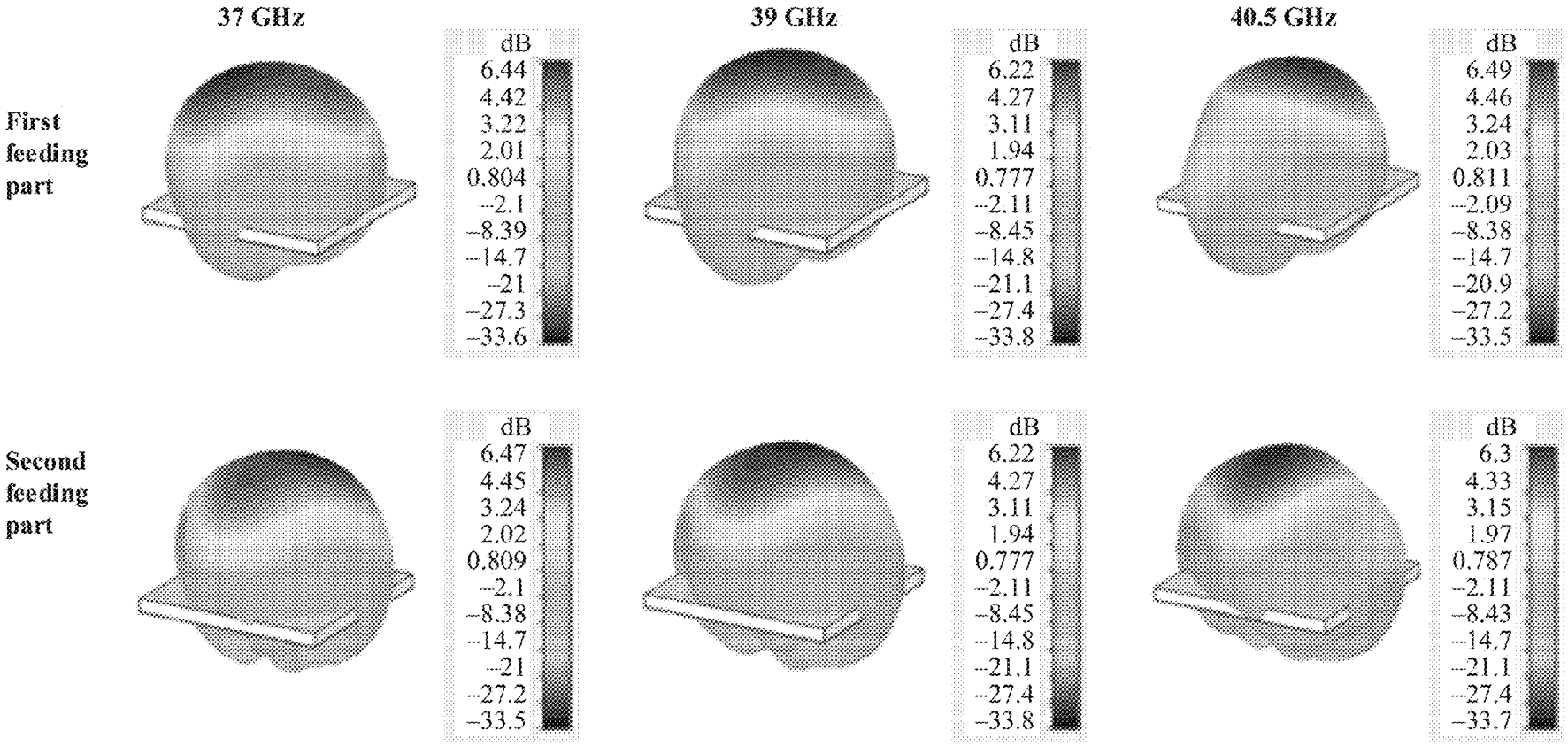
FIG. 14 is a radiation diagram of a millimeter-wave antenna array element in a high frequency band according to this application.

FIG. 14 is a radiation diagram of a millimeter-wave antenna array element in a high frequency band according to this application. As shown in the figure, a direction of maximum radiation energy is perpendicular to a plane of a radiator, and a radiation side lobe value meets a design requirement.

Figure 15:
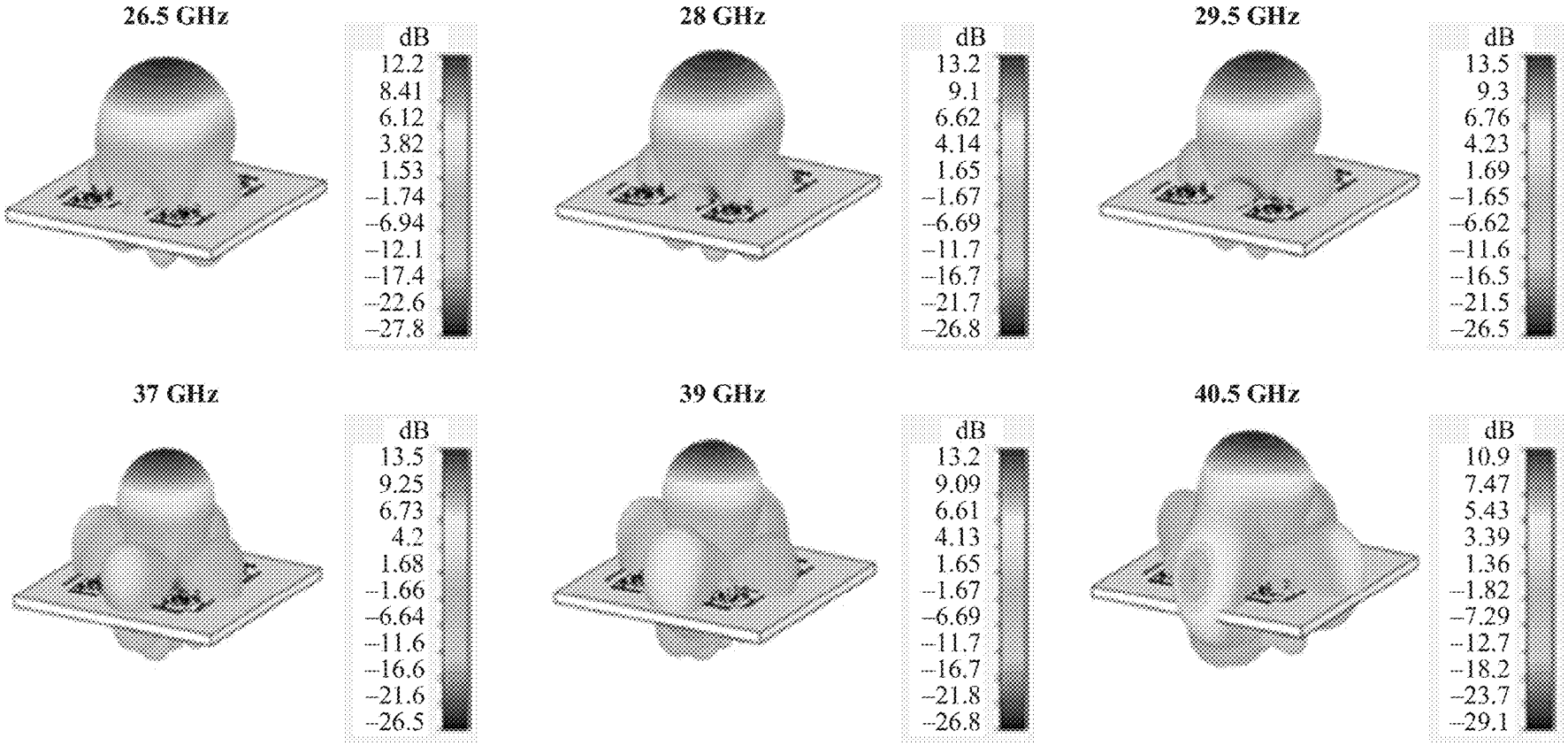
FIG. 15 is a radiation pattern of an array antenna (in an example of a 2×2 array) according to this application.

FIG. 15 is a radiation pattern of an antenna (in an example of a 2×2 array) according to this application. As shown in the figure, the 2×2 antenna array provides an expected gain. To be specific, a beam of a radiation main lobe is narrowed, so that radiation energy is better concentrated in a required direction.

The embodiments of this application are described in detail above. The principle and embodiments of this application are described herein through specific examples. The description about the embodiments of this application is merely provided to help understand the method and core ideas of this application. In addition, a person of ordinary skill in the art can make variations and modifications to this application in terms of the specific embodiments and application scopes according to the ideas of this application. Therefore, the content of specification shall not be construed as a limitation on this application.

What is claimed is:

1. A millimeter-wave antenna array element, comprising:

a ground layer;

a first dielectric layer coupled to the ground layer;

a first radiation patch coupled to the first dielectric layer;

a second dielectric layer coupled to the first radiation patch;

a second radiation patch coupled to the second dielectric layer;

a first feeding part configured to electrically couple to a feed and comprising a first part disposed inside the first dielectric layer, inside the second dielectric layer, or between the first dielectric layer and the second dielectric layer, wherein the first feeding part is insulated from the first radiation patch, the second radiation patch, and the ground layer; and a second feeding part configured to electrically couple to the feed and comprising a second part disposed inside the first dielectric layer, inside the second dielectric layer, or between the first dielectric layer and the second dielectric layer, wherein the second feeding part is insulated from the first feeding part, the first radiation patch, the second radiation patch, and the ground layer, wherein the first feeding part and the second feeding part are configured to, excite first electromagnetic wave signals of two frequency bands to each of the first radiation patch and the second radiation patch; and generate second electromagnetic wave signals with two polarizations on each of the first radiation patch and the second radiation patch.

2. The millimeter-wave antenna array element of claim 1, wherein when the first part and the second part are disposed between the first dielectric layer and the second dielectric layer, the first feeding part comprises a first feeding plate and a first conducting wire, the second feeding part comprises a second feeding plate and a second conducting wire, the first radiation patch comprises a first accommodation hole and a second accommodation hole, the first feeding plate is disposed in the first accommodation hole, the second feeding plate is disposed in the second accommodation hole, the first conducting wire is electrically coupled between the first feeding plate and the feed, and the second conducting wire is electrically coupled between the second feeding plate and the feed.

3. The millimeter-wave antenna array element of claim 2, wherein the first conducting wire extends vertically from the first feeding plate to the ground layer and extends out of the ground layer, and wherein the second conducting wire extends vertically from the second feeding plate to the ground layer and extends out of the millimeter-wave antenna array element from the ground layer.

4. The millimeter-wave antenna array element of claim 2, wherein the first radiation patch is symmetrically distributed along both a first axis and a second axis, wherein the first axis is perpendicular to the second axis, and wherein the first feeding plate and the second feeding plate are respectively disposed on the first axis and the second axis.

5. The millimeter-wave antenna array element of claim 1, further comprising one or more resonators distributed on a periphery of the second radiation patch and insulated from the second radiation patch.

6. The millimeter-wave antenna array element of claim 5, wherein the second radiation patch comprises four sides, wherein the one or more resonators comprises four resonators, and wherein the four resonators are distributed pairwise opposite to each other on the four sides of the second radiation patch.

7. The millimeter-wave antenna array element of claim 6, wherein each of the four resonators is in a strip shape, wherein an extension direction of two resonators of the four resonators that are disposed opposite to each other is a first direction, wherein an extension direction of the other two resonators of the four resonators that are disposed opposite to each other is a second direction, wherein the first direction is perpendicular to the second direction, and wherein the first direction and the second direction, a vertical projection of the second radiation patch on each of the four resonators coincides with each of the four resonators.

8. The millimeter-wave antenna array element of claim 6, wherein each of the four resonators is in a strip shape.

9. The millimeter-wave antenna array element of claim 8, wherein an extension direction of two resonators of the four resonators disposed opposite to each other is a first direction, and wherein an extension direction of the other two resonators of the four resonators that are disposed opposite to each other is a second direction.

10. The millimeter-wave antenna array element of claim 9, wherein the first direction is perpendicular to the second direction, and wherein in the first direction and the second direction, a vertical projection of the second radiation patch on each of the four resonators falls within a range of each of the four resonators.

11. An array antenna, comprising:

a plurality of millimeter-wave antenna array elements, wherein each of the millimeter-wave antenna array elements comprises:

a ground layer, a first dielectric layer coupled to the ground layer;

a first radiation patch coupled to the first dielectric layer, a second dielectric layer coupled to the first radiation patch;

a second radiation patch coupled to the second dielectric layer;

a first feeding part configured to electrically couple to a feed and comprising a first part disposed inside the first dielectric layer, inside the second dielectric layer, or between the first dielectric layer and the second dielectric layer, wherein the first feeding part is insulated from the first radiation patch, the second radiation patch, and the ground layer, and a second feeding part configured to electrically couple to the feed and comprising a second part disposed inside the first dielectric layer, inside the second dielectric layer, or between the first dielectric layer and the second dielectric layer, wherein the second feeding part is insulated from the first feeding part, the first radiation patch, the second radiation patch, and the ground layer, wherein the first feeding part and the second feeding part are configured to:

excite first electromagnetic wave signals of two frequency bands to each of the first radiation patch and the second radiation patch; and excite second electromagnetic wave signals with two polarizations on each of the first radiation patch and the second radiation patch, wherein when the first part and the second part are disposed between the first dielectric layer and the second dielectric layer, the first feeding part comprises a first feeding plate and a first conducting wire, the second feeding part comprises a second feeding plate and a second conducting wire, the first radiation patch comprises a first accommodation hole and a second accommodation hole, the first feeding plate is disposed in the first accommodation hole, the second feeding plate is disposed in the second accommodation hole, the first conducting wire is electrically coupled between the first feeding plate and the feed, and the second conducting wire is electrically coupled between the second feeding plate and the feed, wherein the first conducting wire extends vertically from the first feeding plate to the ground layer and extends out of the ground layer, wherein the second conducting wire extends vertically from the second feeding plate to the ground layer and extends out of the millimeter-wave antenna array element from the ground layer, wherein the millimeter-wave antenna array elements are distributed in an array, wherein each of the first dielectric layers is coplanar and jointly forms a first complete dielectric slab, wherein each of the second dielectric layers is coplanar and jointly forms a second complete dielectric slab, and wherein each of the ground layers is coplanar and interconnected as a whole.

12. The array antenna of claim 11, further comprising an isolation structure disposed between adjacent millimeter-wave antenna array elements, wherein the isolation structure comprises:

an isolation plate disposed on a side that is of the second dielectric layers and that is away from the first dielectric layers and between adjacent second radiation patches; and a plurality of metal through holes that extend from the isolation plate to the ground layers.

13. The array antenna of claim 12, wherein in a direction perpendicular to the second dielectric layers, a first height at which the isolation plate protrudes from the second dielectric layers is greater than a second height at which the second radiation patches protrude from the second dielectric layers.

14. A communications product, comprising:

a feed; and an array antenna comprising a plurality of millimeter-wave antenna array elements, wherein each of the millimeter-wave antenna array elements comprises:

a ground layer;

a first dielectric layer coupled to the ground layer, a first radiation patch coupled to the first dielectric layer, a second dielectric layer coupled to the first radiation patch;

a second radiation patch coupled to the second dielectric layer;

a first feeding part electrically coupled to the feed and comprising a first part disposed inside the first dielectric layer, inside the second dielectric layer, or between the first dielectric layer and the second dielectric layer, wherein the first feeding part is insulated from the first radiation patch, the second radiation patch, and the ground layer; and a second feeding part electrically coupled to the feed and comprising a second part disposed inside the first dielectric layer, inside the second dielectric layer, or between the first dielectric layer and the second dielectric layer, wherein the second feeding part is insulated from the first feeding part, the first radiation patch, the second radiation patch, and the ground layer, wherein the first feeding part and the second feeding part are configured to:

excite first electromagnetic wave signals of two frequency bands to each of the first radiation patch and the second radiation patch; and generate second electromagnetic wave signals with two polarizations on each of the first radiation patch and the second radiation patch, wherein the array antenna further comprises an isolation structure disposed between adjacent millimeter-wave antenna array elements, wherein the isolation structure comprises:

an isolation plate disposed on a side that is of the second dielectric layers and that is away from the first dielectric layers and between adjacent second radiation patches; and a plurality of metal through holes that extend from the isolation plate to the ground layers, wherein in a direction perpendicular to the second dielectric layers, a first height at which the isolation plate protrudes from the second dielectric layers is greater than a second height at which the second radiation patches protrude from the second dielectric layers, and wherein a feed source is configured to feed electromagnetic wave signals into the first feeding part and the second feeding part.

15. An array antenna, comprising:

a plurality of millimeter-wave antenna array elements, wherein each of the millimeter-wave antenna array elements comprises:

a ground layer;

a first dielectric layer coupled to the ground layer;

a first radiation patch coupled to the first dielectric layer;

a second dielectric layer coupled to the first radiation patch;

a second radiation patch coupled to the second dielectric layer;

a first feeding part configured to electrically couple to a feed and comprising a first part disposed inside the first dielectric layer, inside the second dielectric layer, or between the first dielectric layer and the second dielectric layer, wherein the first feeding part is insulated from the first radiation patch, the second radiation patch, and the ground layer; and a second feeding part configured to electrically couple to the feed and comprising a second part disposed inside the first dielectric layer, inside the second dielectric layer, or between the first dielectric layer and the second dielectric layer, wherein the second feeding part is insulated from the first feeding part, the first radiation patch, the second radiation patch, and the ground layer, wherein the first feeding part and the second feeding part are configured to:

excite first electromagnetic wave signals of two frequency bands to each of the first radiation patch and the second radiation patch; and generate second electromagnetic wave signals with two polarizations on each of the first radiation patch and the second radiation patch, wherein when the first part is disposed between the first dielectric layer and the second part is disposed between the second dielectric layer the first feeding part comprises a first feeding plate and a first conducting wire, wherein the second feeding part comprises a second feeding plate and a second conducting wire, wherein the first radiation patch comprises a first accommodation hole and a second accommodation hole, wherein the first feeding plate is disposed in the first accommodation hole, wherein the second feeding plate is disposed in the second accommodation hole, wherein the first conducting wire is electrically coupled between the first feeding plate and the feed, wherein the second conducting wire is electrically coupled between the second feeding plate and the feed, wherein the first conducting wire extends vertically from the first feeding plate to the ground layer and extends out of the ground layer, wherein the second conducting wire extends vertically from the second feeding plate to the ground layer and extends out of the millimeter-wave antenna array element from the ground layer, wherein the millimeter-wave antenna array elements are distributed in an array, wherein all the first dielectric layers are coplanar and jointly form a first complete dielectric slab, wherein all the second dielectric layers are coplanar and jointly form a second complete dielectric slab, and wherein all the ground layers are coplanar and interconnected as a whole.

16. The array antenna according to claim 15, further comprising an isolation structure disposed between adjacent millimeter-wave antenna array elements, wherein the isolation structure comprises:

an isolation plate disposed on a side that is of the second dielectric layers and that is away from the first dielectric layers, wherein the isolation plate is disposed between adjacent second radiation patches; and a plurality of metal through holes that extend from the isolation plate to the ground layers.

17. The array antenna of claim 16, wherein in a direction perpendicular to the second dielectric layers, a first height at which the isolation plate protrudes from the second dielectric layers is greater than a second height at which the second radiation patches protrude from the second dielectric layers.

18. An array antenna, comprising:

a plurality of millimeter-wave antenna array elements, wherein each of the millimeter-wave antenna array elements comprises:

a ground layer;

a first dielectric layer coupled to the ground layer;

a first radiation patch coupled to the first dielectric layer;

a second dielectric layer coupled to the first radiation patch;

a second radiation patch coupled to the second dielectric layer;

a first feeding part configured to electrically couple to a feed and comprising a first part disposed inside the first dielectric layer, inside the second dielectric layer, or between the first dielectric layer and the second dielectric layer, wherein the first feeding part is insulated from the first radiation patch, the second radiation patch, and the ground layer; and a second feeding part configured to electrically couple to the feed and comprising a second part disposed inside the first dielectric layer, inside the second dielectric layer, or between the first dielectric layer and the second dielectric layer, wherein the second feeding part is insulated from the first feeding part, the first radiation patch, the second radiation patch, and the ground layer, wherein the first feeding part and the second feeding part are configured to:

excite first electromagnetic wave signals of two frequency bands to each of the first radiation patch and the second radiation patch; and excite second electromagnetic wave signals with two polarizations on each of the first radiation patch and the second radiation patch, wherein each of the millimeter-wave antenna array elements further comprises one or more resonators distributed on a periphery of the second radiation patch and insulated from the second radiation patch, wherein the second radiation patch comprises four sides, wherein the one or more resonators comprises four resonators, wherein the four resonators are distributed pairwise opposite to each other on the four sides of the second radiation patch, wherein each of the four resonators is in a strip shape, wherein an extension direction of two resonators of the four resonators that are disposed opposite to each other is a first direction, wherein an extension direction of the other two resonators of the four resonators that are disposed opposite to each other is a second direction, wherein the first direction is perpendicular to the second direction, wherein in the first direction and the second direction, a vertical projection of the second radiation patch on the resonator coincides with the resonator, wherein the millimeter-wave antenna array elements are distributed in an array, wherein all the first dielectric layers are coplanar and jointly form a first complete dielectric slab, wherein all the second dielectric layers are coplanar and jointly form a second complete dielectric slab, and wherein all the ground layers are coplanar and interconnected as a whole.

19. The array antenna of claim 18, further comprising an isolation structure disposed between adjacent millimeter-wave antenna array elements, wherein the isolation structure comprises:

an isolation plate disposed on a side that is of the second dielectric layers and that is away from the first dielectric layers, wherein the isolation plate is disposed between adjacent second patches; and a plurality of metal through holes that extend from the isolation plate to the ground layers.

20. The array antenna of claim 19, wherein in a direction perpendicular to the second dielectric layers, a first height at which the isolation plate protrudes from the second dielectric layers is greater than a second height at which the second radiation patches protrude from the second dielectric layers.

* * * * *